US005320356A

United States Patent [19]

Cauda

[11] Patent Number: 5,320,356

[45] Date of Patent: Jun. 14, 1994

[54] METHOD OF PLAYING FAST ACTION BLACKJACK

[75] Inventor: Glenn J. Cauda, Henderson, Nev.

[73] Assignee: Fast Action Games Tech., Inc., Las Vegas, Nev.

[21] Appl. No.: 110,242

[22] Filed: Aug. 23, 1993

[51] Int. Cl.[5] ..... A63F 1/00

[52] U.S. Cl. ..... 273/292; 273/309; 273/274

[58] Field of Search ..... 273/292, 309, 274, 856 P

[56] References Cited

U.S. PATENT DOCUMENTS 5,257,789 11/1993 Le Vasseur ..... 273/292

5,257,810 11/1993 Schorr et al. ..... 273/292

OTHER PUBLICATIONS

Scarne's Encyclopedia of Games "Spit in the Ocean", Harper & Row Publishers, 1973, p. 23.

*Primary Examiner*—Benjamin H. Layno

*Attorney, Agent, or Firm*—J. David Nelson

[57] ABSTRACT

A modified method of playing the card game "Twenty-One" or "Blackjack", wherein a common card, referred to as the "Fast Action Card", is counted in the hands of each of the players and the dealer. To begin a hand, each player makes an ante wager. Then the dealer deals each player and the dealer one card, preferably all face up, and deals the fast action card face down. The players then each have an option to make an additional wager, referred to as the "even money" wager. Each player also has the option to make an insurance wager if the dealer's first card is an ace. Then the fast action card is turned face up and each of the players has the option to double down, based upon the combination of his first card and the fast action card, and to make a double down wager, if his hand qualifies. The play then proceeds in accordance with the conventional manner of play of Twenty-One. Winnings are paid and losing wagers are collected by the dealer.

40 Claims, 1 Drawing Sheet

METHOD OF PLAYING FAST ACTION BLACKJACK

FIELD OF THE INVENTION

This invention relates to a modification of the method of play of Blackjack or Twenty-One, and more particularly to a modification in which the dealer and each of the players play a common card.

BACKGROUND OF THE INVENTION

"Twenty-One", also known as "Blackjack", has historically been widely played as a game of chance at gaming establishments. Each round of the game is a contest between each of the players respectively and the dealer, with each player and the dealer attempting to obtain a hand count of twenty-one or a hand count as close to twenty-one as possible without exceeding twenty-one.

A standard deck of playing cards consisting of numbered cards two through ten, face cards (jack, queen, and king) and an ace, in each of four suits (clubs, diamonds, hearts and spades), is normally used for playing the game of Twenty-One. The numbered cards each have a count equal to the card number, face cards each have a count of ten and each ace has a count of one or eleven, whichever is most beneficial to the count of the hand.

The conventional method of play of the game of Twenty-One utilized by most gaming establishments is as follows:

Each player places his initial wager, also known as his "ante", before any cards are dealt. The wager can be any amount, at the players discretion, between the minimum and maximum limits set by the rules of the gaming establishment, also referred to as the "house" rules. Each player is then dealt two cards, both of which are commonly face down, and the dealer is dealt two cards, one of which is commonly face down and one of which is commonly face up. Each player, in turn, then takes as many "hits" (additional cards) as he elects until he either "stands" (stops with hand count less than or equal to twenty-one) or "busts" (hand count exceeds twenty-one). Each player may stand with any hand count of twenty-one or less. If a player busts, he loses his wager, regardless of whether or not the dealer busts.

After each of the players, in turn, has taken as many hits as he elects and has stood on his hand or busted, the dealer then turns over his face down card and then either stands on his hand or takes hits in accordance with the house rules. Conventionally, the house rules require that the dealer stand on his hand if he has a hand count of seventeen or more and require that he take hits, if his initial hand count is seventeen or less, until he attains a hand count of seventeen or more. After obtaining a hand count of seventeen or more, the dealer is not allowed to take additional hits, unless one of his cards is an ace.

Under the conventional manner of play, the house rules require that the dealer take a hit if his initial hand is an ace and a six ("soft" seventeen), or if, after receiving one or more hits, the dealer's hand consists of an ace and two or more cards that add up to a card count of six. The ace may thereafter be counted with a card count of eleven or one, depending on the hits. Also, under the conventional manner of play, the dealer is required to stand if his initial hand is a soft eighteen, soft nineteen or soft twenty, and the ace is then counted with a card count of eleven.

If the dealer busts, each player who has not busted wins. If the dealer does not bust, then the hand count for each player is compared with the hand count of the dealer. If the hand count of a player exceeds that of the dealer, the player wins. He is commonly paid on a 1-to-1 basis. If the hand count of the dealer exceeds that of the player, the player loses. If the player's hand count ties that of the dealer, it is called a "push" and the rules of play used by the gaming establishment may provide that the player loses his wager or that the player's wager is returned to him.

The conventional method of playing twenty-one which is utilized by most gaming establishments, also includes at least three well-known procedures. These are "insurance", "doubling down" and "splitting pairs".

After each player and the dealer receives their first two cards, if the dealer's "up" card is an ace, each player may elect to make an "insurance" bet. The amount of the insurance bet, for each player making the election, is one-half of the amount of his original ante. Then the dealer, without turning over his face down card, checks the face down card, and if the dealer has a blackjack (a two card, twenty-one count hand), he then turns over the face down card. Each player placing an insurance bet wins and is paid on a 2-to-1 basis for the insurance bet only. All players who do not also have a two card, twenty-one count hand (a blackjack), lose their original ante regardless of their insurance bet. Each player also having a two card twenty-one count hand has his ante returned to him or loses his ante, depending on the house rules.

Another well known procedure utilized by gaming establishments is "doubling down". The initial two card, hand count total which permits a player to elect to "double down", is established by house rules. The three most common double down hand counts utilized by gaming establishments are (a) nine, ten, or eleven; (b) ten or eleven; or (c) eleven only. If the player has an initial two card hand count total equal to one of the values established by the house rules, he may elect to double down. The player informs the dealer of his election to double down and places an additional wager equal to the amount of his original ante. The dealer then deals to that player one and only one additional card, face down, and the resulting three card hand establishes the final count for that player's hand. The player's three card hand count is compared with the dealer's final hand count and the amount of the player's wager is the total of the original ante and the double down bet.

Another well known procedure utilized by gaming establishments is "splitting pairs". If the first two cards of a player's hand are a pair or are both ten count cards, that player may elect to "split" the initial two cards into two separate hands. He then elects to apply his original ante to one of the two hands and places an additional ante for the other hand. Both of the original two cards are then turned face up and the player plays each of the two hands as a separate hand in accordance with the house rules. Some gaming establishments only allow splitting if the player's first two cards are a true pair. House rules may allow a player to double down and may allow him to place an insurance bet on either or both hands.

There are a number of different modifications or variations of the game which are adopted by house rules at various gaming establishments. For example, the game can be played with both of the dealer's initial cards being turned face up, before the players elect to stand or take hits.

The terms conventional method, conventional manner, and conventional rules used in this disclosure and in the claims mean and include or refer to the game of Twenty-One or Blackjack as previously described as well as any of the known variations of the game Twenty-One or Blackjack.

The method of playing Twenty-One as set forth in the patent of LeVasseur, U.S. Pat. No. 5,154,429, cited provides one variant of the game designed to increase the speed of play and to provide a significant variant of the game to promote interest in the game of Twenty-One.

While there are some variations of the game of Twenty-One, some of which are described above, and there are a number of optional procedures, some of which are also described above, there have been few substantially varied versions of the game available to increase the speed of play and to provide variety and stimulate additional interest in the game. The LeVasseur patent cited describes one such variant.

There are certain limitations with conventional Twenty-One, from the perspective of gaming establishments and players respectively. Each round begins with each player and the dealer being dealt two cards. Then each player must make his election to take hits or stand, based upon the evaluation of the two cards of his hand and the count of his cards, while taking into account the dealer's face-up card. Then the dealer must complete his hand by standing or taking hits in accordance with the house rules. Only then are winning and losing hands determined, winning wagers are paid and losing wagers are collected. Aside from sporadic opportunities to make insurance bets, double down bets and splitting bets, interim wagering opportunities are limited.

One objective of the present invention is to provide a significant variant in the method of play of Twenty-One in order to promote increased interest in the game. Another objective of the present invention is to provide additional opportunities for wagering in each round. A further objective of the present invention is to increase the number of rounds the game may be played within any time period. These objectives are of interest to gaming establishments as they desire means for increasing revenue from the game without requiring an increase in the size of the minimum ante placed by each player. These objectives are also of interest to players as they desire additional variety and intensity in the game.

The present invention satisfies each of these objectives. It provides a new significant variation in the method of play which increases interest in the game. It increases the speed and intensity of play and thereby increases the number of rounds of the game that can be played within a specific period of time. It provides an additional wagering opportunity (even money bet) for each player on each round, while preserving the opportunity to place insurance and double down wagers. This increases the potential revenue to gaming establishments and promotes interest in the game.

It is a feature of the present invention to provide that a single card is incorporated into the hand of each of the players as well as the hand of the dealer. Other advantages and features of the present invention as well as additional objects of the invention will become apparent from a consideration of the following detailed description.

SUMMARY OF THE INVENTION

In the present invention, for each round of a game of Twenty-One, each player and the dealer plays a common card, called the "fast action card", which is dealt by the dealer in each round and is incorporated into each player's hand and the dealer's hand. One or more decks or standard playing cards may be used. Extra cards may also be used to vary the odds.

In the preferred manner of play, play is commenced by each player placing an ante wager before any cards have been dealt. The dealer then deals each player one card up and the dealer gets one card up. The dealer then deals the common card, the fast action card, face down. Variations from the preferred manner of play include having the initial card of each of the players and the dealer dealt face down, having the initial card of each of the players dealt face down and the initial card of the dealer dealt face up, or having the initial card of each of the players dealt face up and the initial card of the dealer dealt face down. The fast action card may also be dealt face down or face up.

In the preferred manner of play, each player then has the option to make an additional wager, referred to as an "even money bet" in an amount less than or equal to the amount of the player's ante. Variations of the invention impose different limits on the amount of this wager but this necessitates a different name being used for this wager. A variation may also provide that the opportunity for placing an even money bet precedes the dealing of the fast action card, if the fast action card is to be dealt face up.

If the dealer's face up card is an ace, each player also has the option of insuring his bet by placing an insurance bet equal to one-half of the player's original ante. If playing under a variation where the initial dealer's card is dealt face down, the dealer's card must be turned face up after even money bets are placed, if insurance wagering is to be permitted.

After all even money bets and insurance bets are placed, the dealer exposes the fast action card. Each player then stands or takes hits as necessary to complete his hand. Each player plays his hand and either stands or takes hits with the fast action card considered as a card of his hand.

Each player may double down on a combination of the player's first card and fast action card, with a hand count permitting doubling down being determined by the house rules. The amount of the double down bet is determined by house rules but under the preferred manner of play is equal to the amount of the player's original ante. Then the player receives one and only one additional card to complete his hand.

Splitting is not allowed under the preferred manner of play but may be allowed by house rules.

The dealer completes his hand by standing or taking hits as dictated by the house rules. Under the preferred manner of play, the conventional rules of play of Twenty-One are followed for the present invention for completing the dealer's hand. The preferred manner of play provides that the dealer is required to take a hit once his hand count is a soft seventeen and requires him to stand once his hand count is a soft eighteen, soft nineteen, or soft twenty.

Wins and losses are determined by house rules. Under the preferred manner of play, wins and losses are determined by the conventional rules of play of Twenty-One. Under the preferred manner of play a player loses in the event of a push, except when the player has a hand count of twenty-one.

A winning player's wagers are paid and a losing player's wagers are taken upon the completion of the round. This method of play continues for consecutive rounds of play. Shuffling is performed according to the house rules. Under the preferred manner of play, the conventional rules of Twenty-One are utilized regarding shuffling. The house rules may provide that the dealer has an option to shuffle the deck at any time.

Except where stated otherwise, the preferred manner of play of the present invention is according to the conventional manner of play of Twenty-One.

The present invention can readily be utilized for settings other than a gaming establishment. It can be incorporated readily into an electronic game, an electronic gambling device, or a board game.

DETAILED DESCRIPTION OF THE PREFERRED EMBODIMENTS

Figure 1:
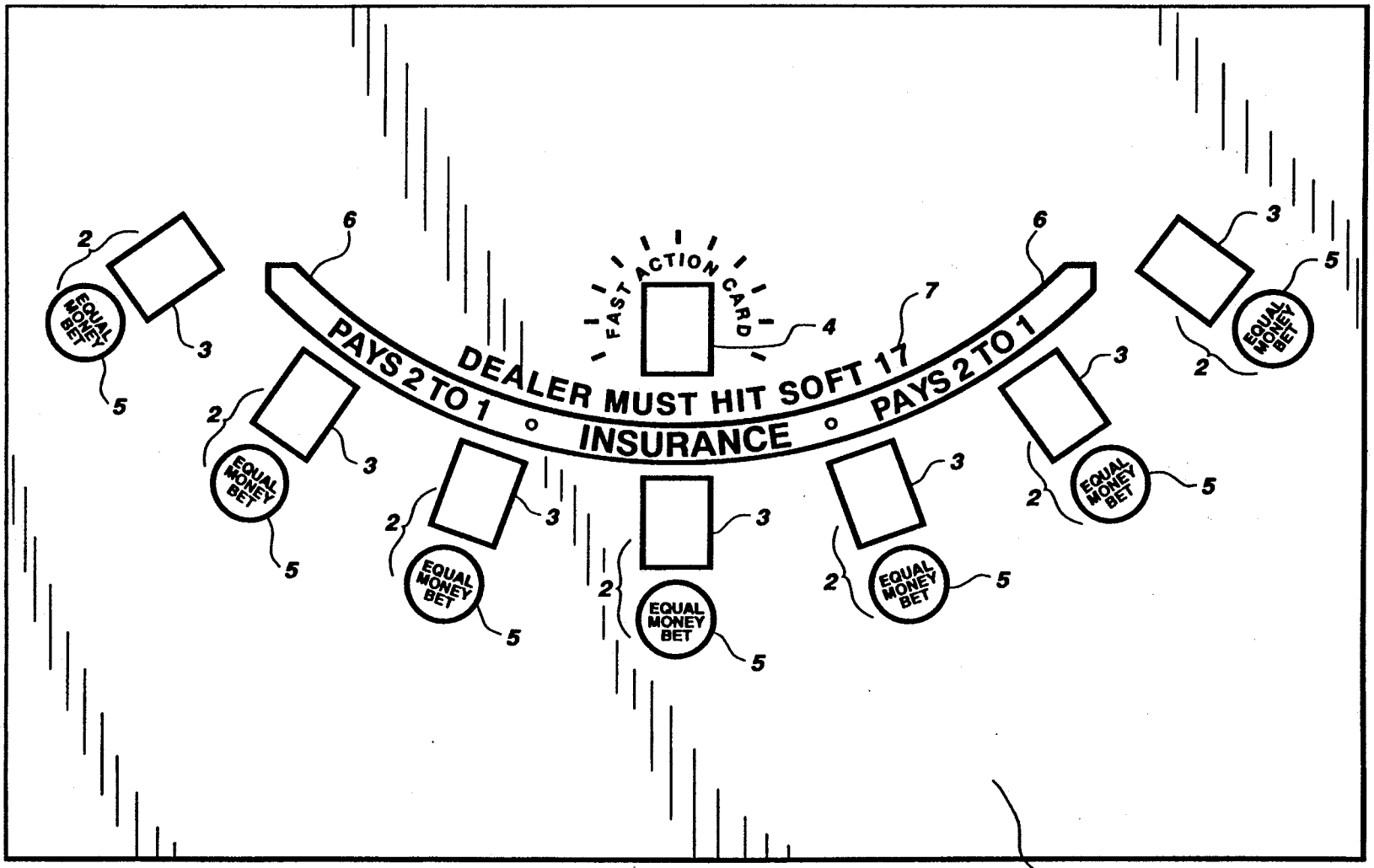
FIG. 1 shows a preferred layout of a table top, game board or electronic display that is used in connection with the modified method of playing the game Twenty-One which is the present invention.

The method of the present invention comprises a modified version of Twenty-One wherein there are one or more players and a dealer, and each player's hand and the dealer's hand incorporates a common card. One or more standard decks of cards may be used. Extra cards may also be added or cards may removed to vary the odds and provide additional variants of the game. Each player places an ante bet at the beginning of each round of the game. The amount of the ante can be of any amount within the maximum and minimum limits established by the house rules of the gaming establishment.

FIG. 1 shows a preferred table top, game board or electronic display that can be used with the method of the present invention. A game table or game board 1 is utilized with a game layout which provides one or more individual player locations 2. Each player places his ante bet within location 3. The dealer deals each of the players one card face up and the dealer is dealt one card face up. The dealer also deals the common card, the "fast action card". The fast action card is placed face down at location 4. Each player then has the option to make a second bet, an "even money bet", by placing within location 5 an amount equal to the amount of his ante. If the dealer's initial face up card is an ace, each player has the option of insuring his bet by placing within location 6 an insurance bet in an amount equal to one-half of the amount his original ante.

In determining the hand count for a player or the dealer, numbered cards two through ten each have a count equal to the face value of the number of the card. Face cards, jack, queen and king, have a count of ten and an ace has a count of one or eleven depending upon which count is most advantageous. However, the conventional rules prescribe certain hand counts wherein the dealer is not given an option on the count of an ace. In the preferred manner of play, the dealer must take a hit on a soft seventeen. This notation 7 is contained on the game table, game board or electronic display layout shown in FIG. 1.

Variations from the preferred manner of play include having the initial card of each of the players and the dealer dealt face down, having the initial card of each of the players dealt face down and the initial card of the dealer dealt face up, or having the initial card of each of the players dealt face up and the initial card of the dealer dealt face down. If playing under a variation where the initial dealer's card is dealt face down, the dealer's card must be turned face up after even money bets are placed, if insurance wagering is to be permitted.

The dealer then turns the fast action card face up and returns it to location 4. If the dealer's hand is other than a blackjack, a two card twenty-one count hand, and the combination of the card count of the fast action card and a player's initial hand card entitles him to elect to double down, he makes the election and places his double down bet within location 3. Under the preferred manner of play, house rules may prescribe that a player may double down when his initial hand count equals nine, ten or eleven, equals ten or eleven, or equals eleven. Variations of the preferred manner of play may allow doubling down on other initial card counts.

After each player has made his insurance and double down elections and the additional bets have been placed, then play continues in the conventional manner. If the dealer has a blackjack then all players lose their initial bet and their even money bet, except those players who also have a blackjack. All insurance bets are payed two to one. Under the preferred manner of play, players also with a blackjack, have their original ante and their even money bet returned. A variation may provide that a player loses in the event of a push, even if he has a blackjack. Variations may also provide for play without insurance wagering or without doubling down or without either.

Then the dealer proceeds to each player in turn who may elect to take any number of additional cards, unless they have made the double down election, until the player's hand count equals or exceeds twenty-one. Players who have elected to double down receive only one additional card. Each player may elect to stand at any hand count which is less than twenty-one.

In the preferred manner of play, splitting is not allowed, but as a variation of the present invention, may be permitted by the house rules.

After all player's have taken hits as desired or have stood on their original hand, the dealer stands or takes hits in accordance with the house rules. In the preferred manner of play, the conventional manner of play of Twenty-One is followed regarding the completion of the dealer's hand. Under the preferred manner of play, the dealer must take a hit on soft seventeen and must stand on a soft eighteen, nineteen or twenty.

In the preferred manner of play, wins and losses and payouts are determined in accordance with the conventional manner of play of Twenty-One. In the preferred manner of play, each player who busts loses all of his wagers except for any insurance winnings which are paid at the time that the fast action card is turned face up. If the dealer busts, each player who did not also bust is paid one to one on his original ante and one to one on any even money bet. Double down bets are also paid one to one. If the dealer does not bust, the hand count total of each player is compared with the hand count total of the dealer. If the player's hand count total is greater than the hand count total of the dealer and does not exceed twenty-one, the player wins and receives a one to one payout on his original ante and a one to one payout on any even money bet or double down bet. If a player has a blackjack, he receives a one and one-half to one payout on his original ante and a one to one payout on his even money bet. In the event of a tie between a player and the dealer, the player loses his wagers, except when both the player and the dealer have a blackjack or both the player and the dealer have a twenty-one hand count with three or more cards, in which case the player's wagers are returned.

Variations of the present invention provide that a different amount or a range of amounts is allowed for the second bet. Variations of the present invention also provide that different amounts or ranges of amounts be allowed for the insurance wager or the double down wager, or both.

The present invention is also readily adaptable to electronic gaming devices such as U.S. Pat. No. 4,614,342, Takashima referenced above. The present invention is also readily adaptable to board games.

Except for the modifications of the conventional manner of play for Twenty-One as is indicated for the preferred embodiments, the preferred manner of play is the conventional manner of play of Twenty-One. Each of the known variants of the conventional manner are included. The foregoing description of the preferred embodiments of the invention are intended to be illustrative rather than limiting. The addition of other procedures, modifications and variations may be utilized and will be apparent to those skilled in the art. Therefore, the invention is not limited by the foregoing description, but rather is defined by the following claims.

What is claimed is:

1. A method of playing a modified version of Twenty-One wherein one or more players and a dealer each play a common card comprising:

a) each player making an ante wager;
b) the dealer dealing one card to each player, one card to the dealer, and the common card;
c) each player having the option of making an additional wager;
d) each player standing or taking hits as the player desires in accordance with the conventional manner of play of Twenty-One, defining the player's hand;
e) the dealer standing or taking hits in accordance with the conventional manner of play of Twenty-One, defining the dealer's hand;
f) the dealer comparing his hand to each of the players' hands in accordance with the conventional manner of play of Twenty-One; and
g) the dealer paying winnings and collecting losing wagers.

2. The method of play described in claim 1, wherein each player has the option of making an insurance wager after the dealer's initial card is turned face up and prior to the common card being turned face up, if the dealer's first card is an ace.

3. The method of play described in claim 1, wherein each player has the option of making a double down election and making a double down wager after the common card is turned face up if the hand count of his initial card and the common card equals one of a set of prescribed values.

4. The method of play described in claim 1 wherein the first card dealt to each player and the first card dealt to the dealer are dealt face up, the common card is dealt face down, and the common card is turned face up after the optional wagers are made.

5. The method of play described in claim 1 wherein the first card dealt to each player is dealt face up, the first card dealt to the dealer is dealt face down, the common card is dealt face down, and the common card is turned face up after the optional wagers are made.

6. The method of play described in claim 1 wherein the first card dealt to each player is dealt face down, the first card dealt to the dealer is dealt face up, the common card is dealt face down, and the common card is turned face up after the optional wagers are made.

7. The method of play described in claim 1 wherein the first card dealt to each player is dealt face down, the first card dealt to the dealer is dealt face down, and the common card is dealt face up.

8. The method of play described in claim 1 wherein the first card dealt to each player is dealt face up, the first card dealt to the dealer is dealt face down, and the common card is dealt face up.

9. The method of play described in claim 1 wherein extra cards are utilized.

10. A method of playing a modified version of Twenty-One wherein one or more players and a dealer each play a common card comprising:

a) each player making an ante wager;
b) the dealer dealing one card face up to each of the players, one card face up to the dealer and the common card face down;
c) each player having an option of making an additional wager in an amount less than or equal to the amount of his ante;
d) the dealer turning the common card face up;
e) each player standing or taking hits as the player desires in accordance with the conventional manner of play of Twenty-One, defining the player's hand;
f) the dealer standing or taking hits in accordance with the conventional manner of play of Twenty-One, defining the dealer's hand;
g) the dealer comparing his hand to each of the players' hands in accordance with the conventional manner of play of Twenty-One;
h) the dealer paying winnings to each winning player based on the amount of the player's ante and the amount of the player's optional wager; and
i) the dealer collecting the wagers of each losing player.

11. The method of play described in claim 10, wherein each player has the option of making an insurance bet prior to the common card being turned face up, if the dealer's first card is an ace.

12. The method of play described in claim 10, wherein each player has the option of making a double down election and making a double down wager after the common card is turned face up if the hand count of his initial card and the common card equals one of a set of prescribed values.

13. The method of play described in claim 10, wherein extra cards are utilized.

14. A method of playing a modified version of Twenty-One wherein one or more players and a dealer each play a common card comprising:

a) the dealer dealing one card to each player, one card to the dealer and the common card;
b) the dealer turning the common card face up;
c) each player standing or taking hits as the player desires in accordance with the conventional manner of play of Twenty-One, defining the player's hand;
d) the dealer standing or taking hits in accordance with the conventional manner of play of Twenty-One, defining the dealer's hand;

e) the dealer comparing his hand to each player's hand in accordance with the conventional manner of play of Twenty-One; and f) a player winning if the player's hand beats the dealer's hand or a player losing if the dealer's hand beats the player's hand in accordance with the conventional manner of play of Twenty-One.

15. The method of play described in claim 14 wherein the first card dealt to each player and the first card dealt to the dealer are dealt face up and the common card is dealt face down.

16. The method of play described in claim 14 wherein the first card dealt to each player is dealt face up, the first card dealt to the dealer is dealt face down, and the common card is dealt face down.

17. The method of play described in claim 14 wherein the first card dealt to each player is dealt face down, the first card dealt to the dealer is dealt face up, and the common card is dealt face down.

18. The method of play described in claim 14 wherein the first card dealt to each player is dealt face down, the first card dealt to the dealer is dealt face down, and the common card is dealt face up.

19. The method of play described in claim 14 wherein the first card dealt to each player is dealt face up, the first card dealt to the dealer is dealt face down, and the common card is dealt face up.

20. The method of play described in claim 14 wherein extra cards are utilized.

21. A method of playing a modified version of Twenty-One wherein one or more players and a dealer each play a common card utilizing an electronic display of the game comprising:

a) each player making an ante wager;

b) displaying one card to each player, one card to the dealer, and the common card;

c) each player making an optional additional wager;

d) each player standing or taking hits as the player desires in accordance with the conventional manner of play of Twenty-One, defining the player's hand;

e) the dealer standing or taking hits in accordance with the conventional manner of play of Twenty-One, defining the dealer's hand;

f) comparing the dealer's hand to each of the players' hands in accordance with the conventional manner of play of Twenty-One; and g) paying winnings and collecting losing wagers.

22. The method of play described in claim 21, wherein each player has the option of making an insurance wager after the dealer's initial card is displayed face up and prior to the common card being displayed face up, if the dealer's first card is an ace.

23. The method of play described in claim 21, wherein each player has the option of making a double down election and making a double down wager after the common card is displayed face up if the hand count of his initial card and the common card equals one of a set of prescribed values.

24. The method of play described in claim 21 wherein the first card dealt to each player and the first card dealt to the dealer are dealt face up, the common card is dealt face down, and the common card is displayed face up after the optional wagers are made.

25. The method of play described in claim 21 wherein the first card dealt to each player is dealt face up, the first card dealt to the dealer is dealt face down, the common card is dealt face down, and the common card is displayed face up after the optional wagers are made.

26. The method of play described in claim 21 wherein the first card dealt to each player is dealt face down, the first card dealt to the dealer is dealt face up, the common card is dealt face down, and the common card is displayed face up after the optional wagers are made.

27. The method of play described in claim 21 wherein the first card dealt to each player is dealt face down, the first card dealt to the dealer is dealt face down, and the common card is dealt face up.

28. The method of play described in claim 21 wherein the first card dealt to each player is dealt face up, the first card dealt to the dealer is dealt face down, and the common card is dealt face up.

29. The method of play described in claim 21 wherein extra cards are utilized.

30. A method of playing a modified version of Twenty-One wherein one or more players and a dealer each play a common card utilizing an electronic display of the game comprising:

a) each player making an ante wager;

b) displaying one card face up to each of the players, one card face up to the dealer and the common card face down;

c) each player having an option of making an additional wager in an amount less than or equal to the amount of his ante;

d) displaying the common card face up;

e) each player standing or taking hits as the player desires in accordance with the conventional manner of play of Twenty-One, defining the player's hand;

f) the dealer standing or taking hits in accordance with the conventional manner of play of Twenty-One, defining the dealer's hand;

g) comparing the dealer's hand to each of the players' hands in accordance with the conventional manner of play of Twenty-One;

h) paying winnings to each winning player based on the amount of the player's ante and the amount of the player's optional wager; and i) collecting the wagers of each losing player.

31. The method of play described in claim 30, wherein each player has the option of making an insurance bet prior to the common card being displayed face up, if the dealer's first card is an ace.

32. The method of play described in claim 30, wherein each player has the option of making a double down election and making a double down wager after the common card is displayed face up if the hand count of his initial card and the common card equals one of a set of prescribed values.

33. The method of play described in claim 30, wherein extra cards are utilized.

34. A method of playing a modified version of Twenty-One wherein one or more players and a dealer each play a common card utilizing an electronic display of the game comprising:

a) displaying one card to each player, one card to the dealer and the common card;

b) displaying the common card face up;

c) each player standing or taking hits as the player desires in accordance with the conventional manner of play of Twenty-One, defining the player's hand;

d) the dealer standing or taking hits in accordance with the conventional manner of play of Twenty-One, defining the dealer's hand;

e) comparing the dealer's hand to each player's hand in accordance with the conventional manner of play of Twenty-One; and f) a player winning if the player's hand beats the dealer's hand or a player losing if the dealer's hand beats the player's hand in accordance with the conventional manner of play of Twenty-One.

35. The method of play described in claim 34 wherein the first card dealt to each player and the first card dealt to the dealer are dealt face up and the common card is dealt face down.

36. The method of play described in claim 34 wherein the first card dealt to each player is dealt face up, the first card dealt to the dealer is dealt face down, and the common card is dealt face down.

37. The method of play described in claim 34 wherein the first card dealt to each player is dealt face down, the first card dealt to the dealer is dealt face up, and the common card is dealt face down.

38. The method of play described in claim 34 wherein the first card dealt to each player is dealt face down, the first card dealt to the dealer is dealt face down, and the common card is dealt face up.

39. The method of play described in claim 34 wherein the first card dealt to each player is dealt face up, the first card dealt to the dealer is dealt face down, and the common card is dealt face up.

40. The method of play described in claim 34 wherein extra cards are utilized.

* * * * *